US006126269A

United States Patent [19]

Takemoto et al.

[11] Patent Number: 6,126,269

[45] **Date of Patent: *Oct. 3, 2000**

[54] NOZZLE PLATE FOR INK JET PRINTER AND METHOD OF MANUFACTURING SAID NOZZLE PLATE

[75] Inventors: Kiyohiko Takemoto; Shuichi Yamaguchi; Akio Yamamori; Kazushige Haketa; Yukiyoshi Icyu, all of Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/879,521

[22] Filed: Jun. 20, 1997

Related U.S. Application Data

[63] Continuation of application No. 08/331,741, Oct. 31, 1994, abandoned.

[30] Foreign Application Priority Data

Oct. 29, 1993 [JP] Japan ..... 5-294183

[51] Int. Cl.[7] ..... B41J 2/135; B41J 2/14

[52] U.S. Cl. ..... 347/45; 347/47

[58] Field of Search ..... 347/45, 47

[56] References Cited

U.S. PATENT DOCUMENTS

| | | | |
|---|---|---|---|
| 4,296,421 | 10/1981 | Hara et al. | 347/56 |
| 5,148,193 | 9/1992 | Inamoto et al. . | |
| 5,387,440 | 2/1995 | Takemoto et al. | 347/45 |

FOREIGN PATENT DOCUMENTS

| | | | |
|---|---|---|---|
| 0506128 | 9/1992 | European Pat. Off. . | |
| 0521697 | 1/1993 | European Pat. Off. . | |
| 0531535 | 3/1993 | European Pat. Off. . | |
| 0531535A1 | 3/1993 | European Pat. Off. | 347/45 |
| 2460131 | 1/1976 | Germany . | |
| 55-65564 | 5/1980 | Japan . | |
| 57-107848 | 5/1982 | Japan . | |
| 62-242546 | 10/1987 | Japan . | |
| 63-022660 | 1/1988 | Japan . | |
| 255140 | 2/1990 | Japan . | |
| 04294145 | 10/1992 | Japan | 347/45 |
| 2277299 | 10/1994 | United Kingdom . | |

*Primary Examiner*—John Barlow
*Assistant Examiner*—Christina Annick
*Attorney, Agent, or Firm*—Sughrue, Mion, Zinn, Macpeak & Seas, PLLC

[57] ABSTRACT

A nozzle plate free from stray fly and defective jetting is achieved by a method which has a first step of putting a photosensitive resin film 5 in pressure contact with a back surface of a nozzle plate 1. A part of the photosensitive resin film 5 is caused to step into a nozzle 4 by controlling the viscosity thereof by changing temperature. Then, the thus processed photosensitive resin film 5 is hardened by injecting ultraviolet rays thereto. Next, a front surface 2 of the nozzle plate 1 is subjected to a eutectoid plating 6 process. By regulating a step coverage d of a part of the eutectoid plating 6 into the nozzle 4 by the hardened photosensitive resin film 5, a-nozzle plate having consistent nozzles, each being free from stray fly and defective jetting can be formed.

11 Claims, 4 Drawing Sheets

NOZZLE PLATE FOR INK JET PRINTER AND METHOD OF MANUFACTURING SAID NOZZLE PLATE

This is a Continuation of application Ser. No. 08/331,741, filed on Oct. 31, 1994 now abandoned.

BACKGROUND OF THE INVENTION

1. Field of the Invention

The present invention relates to a nozzle plate for an ink jet printer and a method of manufacturing such a nozzle plate.

2. Description of the Related Art

An ink jet printer of a type in which a recording image is written onto a recording medium by ink droplets jetted from nozzles has a problem in that the direction in which each ink droplet travels deviates from a prescribed course because the vicinity of the nozzle becomes wet with ink.

To overcome this problem, a nozzle plate disclosed in Japanese Unexamined Patent Publication No. 57-107148 is designed to control the wetness of the neighborhood of the nozzle by uniformly forming by sputtering an ink-repellent coating layer, such as a fluorescent film, on both the inner surface of the nozzle and the front surface of the nozzle plate.

Keeping the vicinity of the nozzle from becoming wet with ink, the nozzle plate according to the aforementioned invention is advantageous in successfully stably splashing an ink droplet in the axial direction. However, the method of forming the ink-repellent coating employed by the aforementioned invention is not successful in making step coverage of the ink-repellent coating consistent. As a result, if the step coverage is too large and excessive, the center of vibration of the meniscus moves away from the front surface of the nozzle plate according to the degree of excess coverage. This in turn demands greater energy for jetting a predetermined amount of ink and thus deteriorates jetting efficiency. If the step coverage is too small, the center of vibration of the meniscus comes closer to the front surface of the nozzle plate, which in turn causes "misfire". That is, another ink droplet is jetted due to the meniscus being vibrated after an ink droplet has been jetted, and thus causes great inconsistency among products, impairing reliability.

SUMMARY OF THE INVENTION

The present invention has been made in consideration of the aforementioned problems and an object of the present invention resides is to provide a novel nozzle plate that can achieve stable jetting of ink droplets by limiting the step coverage of an ink-repellent substance over the inner surface of a nozzle to a predetermined range.

Another object of the present invention is to provide a method of preparing such a novel nozzle plate that can limit the step coverage of an ink-repellent coating over the inner surface of a nozzle to a predetermined range.

To accomplish the aforementioned objects, the present invention is applied to a nozzle plate of an ink jet printer in which a part of an ink-repellent coating layer for covering the front surface of the nozzle plate in caused to step into the inner surface of a nozzle so that the volume of a space within the nozzle from the front surface of the nozzle plate to a meniscus forming surface is limited to a range from 0.05 to 0.50 with respect to the amount of ink to be jetted.

In addition, the method of preparing a nozzle plate for an ink jet printer involves the steps of putting a photosensitive resin member in pressure contact with the back surface of the nozzle plate, and heating the photosensitive resin member to cause a part of the photosensitive resin member to step into the inner surface of a nozzle so that the volume of a space within the nozzle from the surface of the nozzle plate can be limited to a range from 0.05 to 0.50 with respect to the amount of ink to be jetted; and then hardening the photosensitive resin member by rays of light, and forming an ink-repellent coating layer at least on the inner surface of the nozzle and the front surface of the nozzle plate with the hardened photosensitive resin member as a masking member.

DETAILED DESCRIPTION OF THE PREFERRED EMBODIMENTS

Embodiments of the present invention will now be described with reference to the drawings.

Figure 1A:
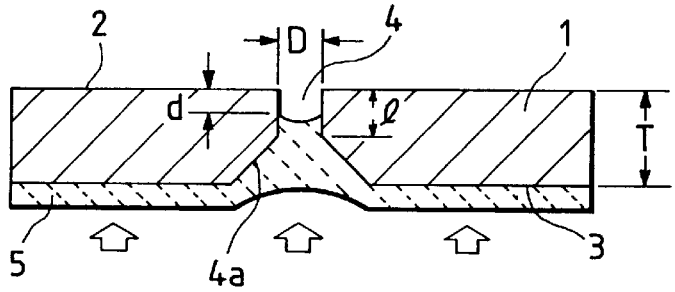
FIGS. 1(*a*) to (*d*) are diagrams showing a process of forming a nozzle plate, which is an embodiment of the present invention.
Figure 1B:
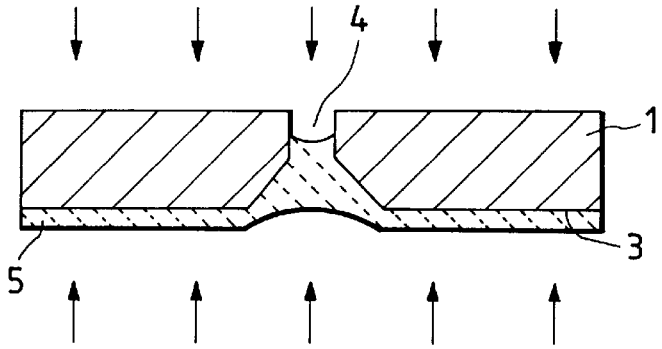
Figure 1C:
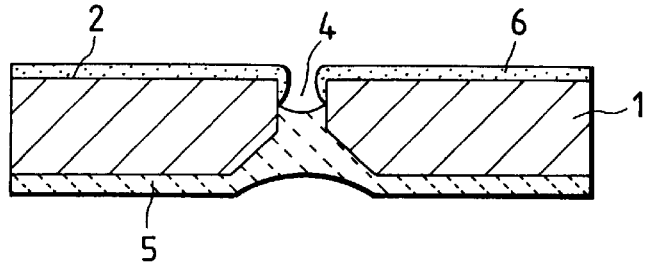
Figure 1D:
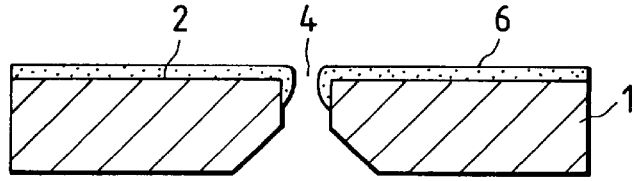
Figure 2:
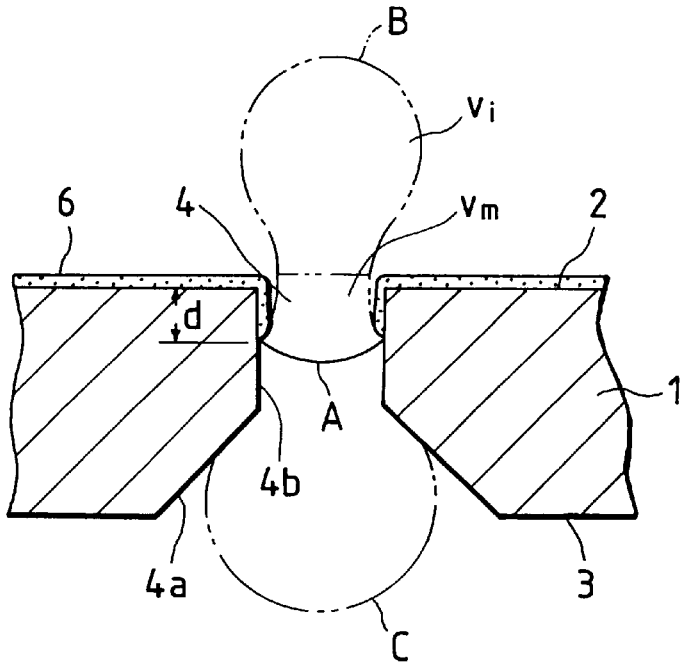
FIG. 2 is an enlarged sectional view showing a main portion of the nozzle plate, which is another embodiment of the present invention.
Figure 3:
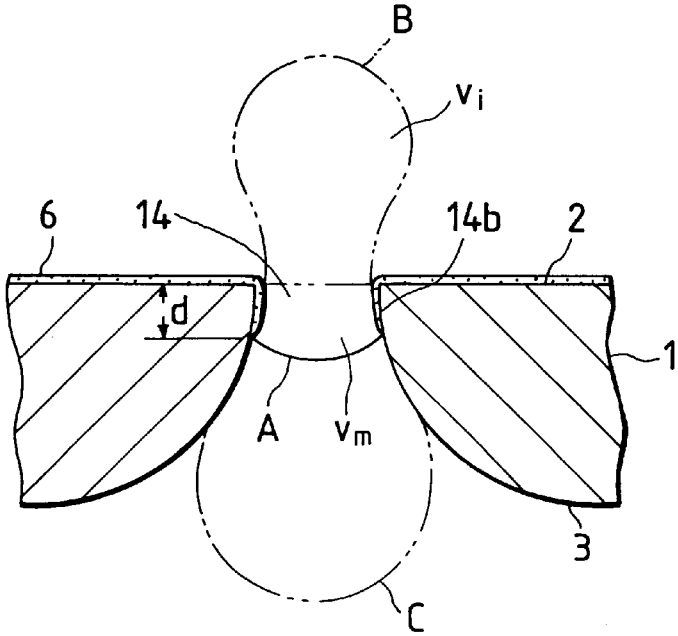
FIG. 3 is an enlarged sectional view showing a main portion of a nozzle plate, which is yet another embodiment of the present invention.
Figure 4A:
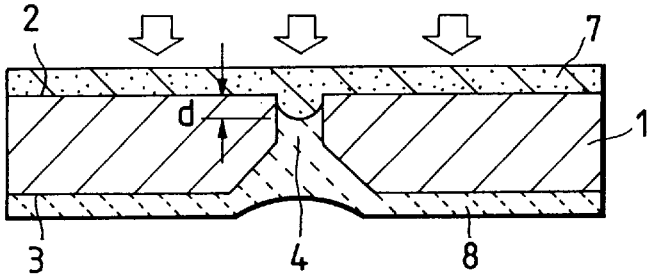
FIGS. 4(*a*) to (*d*) are diagrams showing a process of forming a nozzle plate, which is still another embodiment of the present invention.
Figure 4B:
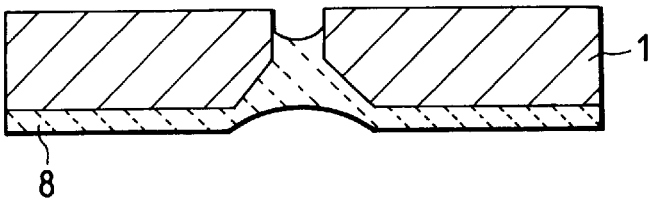
Figure 4C:
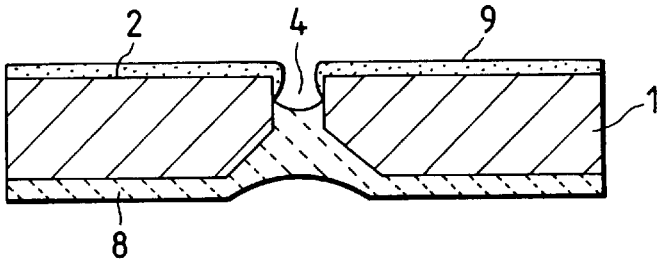
Figure 4D:
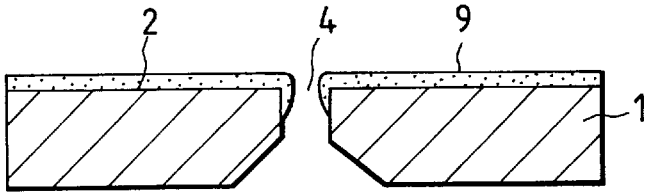

FIG. 1 shows a process of preparing a nozzle plate, which is an embodiment of the present invention, and more particularly shows a surface treatment process to which the nozzle plate is subjected; FIGS. 2 and 3 show the nozzle plate prepared by such a process.

A nozzle plate denoted by reference numeral 1 in FIG. 1 is made of metal, ceramic, silicon, glass, plastic, and the like, or more preferably of a single material such as titanium, chromium, iron, cobalt, nickel, copper, zinc, tin, gold, or an alloy such as a nickel-phosphor alloy, a tin-copper-phosphor alloy (phosphor bronze), a copper-zinc alloy, a stainless steel, or polycarbonate, polyeulfone, ABS resins (acrylonitrile butadiene styrene copolymer), polyethylene terephthalate, polyacetal, or a variety of photosensitive resin materials. The nozzle plate 1 has a plurality of nozzle holes 4, each nozzle hole including a funnel-shaped portion 4*a* opening to the back surface 3 and a cylinder-like orifice portion 4*b* (see FIG. 2) opening to the front surface 2.

A photosensitive resin film 5 that is hardened by light, e.g., a dry film resist made of DAIYARON FRA304-38 (trade name) manufactured by Mitsubishi Rayon Co., Ltd., is first laminated on the back surface 3 of the nozzle plate 1, and a part of the photosensitive resin film 5 is then stepped into the nozzle 4 to a depth of 5 to 40 $\mu$m from the front surface of the nozzle plate by heating the photosensitive resin film 5 to a temperature of 40 to 70° C. while applying a pressure of approximately 4.0 kgf/cm$^2$ to the photosensitive resin film 5 (FIG. 1(*a*)).

Then, ultraviolet rays are injected from both the back surface 3 and the front surface 2 of the nozzle plate 1 to harden the photosensitive resin film 5 formed on the back surface 3 of the nozzle plate 1 and stepped into the nozzle 4 as a whole (FIG. 1(*b*)).

This process in considered as a pre-process for regulating a step coverage d of a eutectoid plating 6 into the nozzle 4 in a subsequent eutectoid plating layer forming process.

The viscosity of the photosensitive resin material used to regulate the step coverage d of the plating layer 6 is generally changed greatly by temperature. Therefore, to allow a part of the photosensitive resin film 5 to step into the nozzle 4 to the predetermined step coverage d, it is expedient to fix the pressure applied to the photosensitive resin film 5 to a constant level and control the temperature t at which the film 5 is heated.

Figure 5:
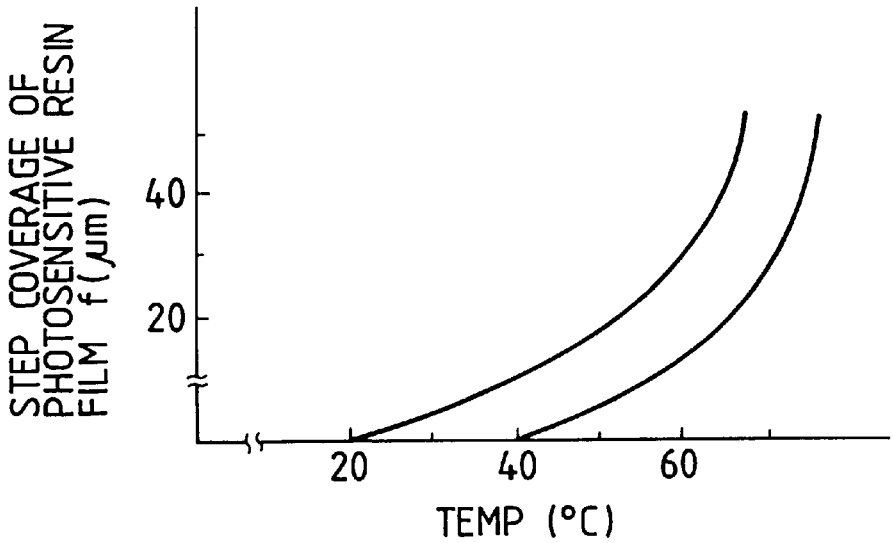
FIG. 5 is a diagram showing a relationship between the temperature and the step coverage of a photosensitive resin film.

An example of a process according to this embodiment will be described. In this example, an ordinary nozzle plate 1, having a thickness T of 80 μm, a nozzle diameter D of 40 μm, and a nozzle length (cylinder-like portion) 1 of 35 μm was used. A photosensitive resin film 5 having a thickness of 38 μm was bonded to the back surface 3, and the photosensitive resin film 5 was heated for 20 seconds at various temperatures t with pressures of 4.0 kgf/cm$^2$ and 5.0 kgf/cm$^2$ applied thereto. As a result, a relationship as shown in FIG. 5 was obtained between the temperature t and a step coverage f of the photosensitive resin film 5.

Ultraviolet rays, having a wavelength of 365 nm, for hardening the photosensitive resin film 5 were irradiated in an amount of 750 mJ/cm$^2$ in this example of the embodiment.

Then, the thus processed nozzle plate 1 was immersed into an electrolyte in which nickel ions and particles of a water-repellent high molecular resin such as polytetrafluoroethylene were dispersed by electric charges and stirred therein to form a eutectoid plating layer 6 on the front surface of the nozzle plate 1 (FIG. 1(*c*)).

A fluorine-containing high molecular material used for the mutectoid plating process includes a resin such as polytetrafluoroethylene, polyperfluoroalkoxybutadiene, polyfluorovinylidene, polyfluorovinyl, or polydiperfluoroalkylfumarate. Such resin is used singly or in combination.

The matrix of this plating layer 6 is not particularly limited. While metals such as, copper, silver, zinc, or tin are appropriate, a metal such as nickel, or an alloy such as a nickel-cobalt alloy, a nickel-phosphor alloy, or a nickel-boron alloy, which exhibits a large surface hardness and excellent wear resistance is preferable.

Accordingly, the particles of polytetra-fluoroethylene uniformly cover the front surface 2 of the nozzle plate 1 as well as the inner circumference of the nozzle 4 to a predetermined depth from the front surface 2.

The photosensitive resin film 5 formed on the back surface 3 of the nozzle plate 1 and stepped into the nozzle 4 is thereafter removed by using an appropriate solvent. Then, by preventing the nozzle plate 1 from warping while applying a load thereto, the thus processed nozzle plate 1 is heated to a temperature higher than the melting point of the fluorine-containing high molecular material (higher than the melting point of 350 degrees C of polytetraf luoroethylene of the current example), to form a hard ink-repellent plating layer 6 on the front surface 2 as well as on the inner circumference of the nozzle to a predetermined depth (FIG. 1(*d*)).

Therefore, for the thus prepared nozzle plate 1, the lower edge of the ink-repellent plating layer 6 within the nozzle 4 plays an important role in determining the center of vibration A of the meniscus of ink as shown in FIG. 2. The ink-repellent coating (and, in particular, the lower edge of the ink-repellent coating in nozzle 2) may be understood as a means for regulating the position of the center of vibration A of the meniscus.

Figure 6:
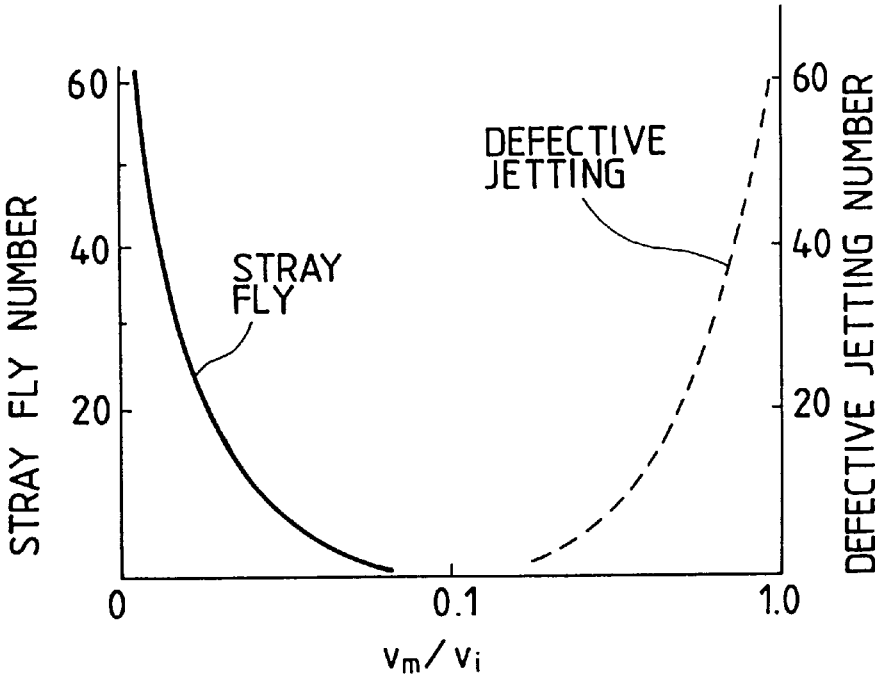
FIG. 6 is a diagram showing a relationship between Vm/Vi and the frequencies of stray fly and defective jetting.

Assuming that the volume of a space within the nozzle from the front surface 2 of the nozzle 4 to the center of vibration A of the meniscus is Vm, and the volume of ink within a space from the front surface 2 of the nozzle 4 to the front surface B of the ink immediately before the ink is jetted, (i.e., the volume of an ink droplet to be jetted) is Vi, then a smaller step coverage d of the plating layer 6 makes Vm/Vi smaller, which thereby allows the piezoelectric drive voltage to be decreased. The piezoelectric drive voltage serves to ensure that a desired amount of ink is jetted. Hence, an inexpensive driver can be achieved. However, if the step coverage d is set to too small a value, stray fly occurs as shown in FIG. 6 and Table 1.

On the other hand, if the step coverage d of the plating layer 6 is large, a position C to which the meniscus retreats after the ink has been jetted becomes so deep that air bubbles are picked up in the front of the nozzle 4 or defective jetting results due to insufficient supply of ink for the next ink droplet jetting operation.

Nozzle plates 1 having a thickness of 80 μm and having different step coverages d were prepared, and attached to a piezoelectrically driven on-demand ink jet printer to carry out a test in which 0.1 μg/dot-ink droplets were continuously jetted from a nozzle 4 having a diameter of 40 μm for 30 seconds at a response frequency of 5 KHz. The test was repeated 100 times, and the frequency of flightdeviation, defective jetting, and the like was counted. The following results were obtained.

TABLE 1

| d μm | Vm ×10$^{14}$ mm$^3$ | PZT Drive Voltage V | PZT Dis-placement Energy ×10$^7$ J | Vm/Vl | Frequency of flight Deviation | Frequency of Defective Jetting |
|---|---|---|---|---|---|---|
| 0 | 0 | 20 | 4.5 | 0 | 62 | 0 |
| 2 | 0.25 | 20 | 4.5 | 0.025 | 13 | 0 |
| 4 | 0.5 | 21 | 5.0 | 0.05 | 0 | 0 |
| 5 | 0.6 | 21 | 5.0 | 0.06 | 0 | 0 |
| 15 | 1.9 | 23 | 6.0 | 0.19 | 0 | 0 |
| 40 | 5.0 | 26 | 7.6 | 0.50 | 0 | 0 |
| 50 | 7.5 | 42 | 19.8 | 0.75 | 0 | 24 |
| 60 | 9.0 | 70* | 55.1 | 0.90 | 0 | 89 |

It was verified from these tests that when Vm/Vi, (that is, the ratio of the volume of the space within the nozzle from the front surface 2 of the nozzle plate 1 to the meniscus forming surface A with respect to the amount of an ink droplet to be jetted) is smaller than 0.04, the frequency of flight deviation of the ink droplet increases drastically. It was also verified that when this ratio exceeds 0.50, the incidence of defective jetting increases drastically.

Incidently, the above are the results of the tests carried out on the nozzle 4 having a cylinder-like orifice portion 4*b* on the front surface 2 and a funnel-shaped portion 4*a* that opens widely to the back surface 3. As to a nozzle 14 that is opened so as to flare bell-like to the back surface 3 from an orifice portion 14*b* on the front surface 2, as shown in FIG. 3, a similar tendency was observed from the results of tests.

It is understood from the above that the step coverage d of the plating layer 6 should be determined so that Vm/Vi is within a range from 0.04 to 0.5 or, more preferably, within a range from 0.05 to 0.5.

FIG. 4 shows a second embodiment of the present invention, which pertains to a method of treating the surface of the nozzle plate 1.

This method involves the steps of: first putting a resilient plate 7 made of, for example, rubber in pressure contact with the front surface 2 of the nozzle plate 1 with a predetermined biasing force, and causing a. part of the resilient plate 7. to step into the nozzle 4 by a value equivalent to a predetermined step coverage d; and then applying a dry film resist or an appropriate plastic material 8 as a masking member 8 over the entire back surface 3. of the nozzle plate 1 including the nozzle 4 portion (FIG. 4(*a*)).

When the dry film resist is used as a masking member 8, ultraviolet rays are thereafter irradiated from the back surface 3 to harden the dry film resist, whereas when the plastic material is used, the plastic material is either heated or subjected to an ordinary drying process to solidify the plastic material, and then the resilient plate 7 is removed from the front surface 2 of the nozzle plate 1 (FIG. 4(*b*)).

Further, the thus processed nozzle plate 1 is immersed into an electrolyte in which the particles of a water-repellent high molecular resin are dispersed by electric charges to form an ink-repellent coating layer 9, which is a eutectoid plating layer, on the front surface 2 thereof, or a fluorine-containing high molecular water-repellent agent is applied to the front surface 2 of the thus processed nozzle plate 1 by sputtering or dipping (FIG. 4(*c*)). As the final step, the masking member 8 is removed from the back surface 3 of the nozzle plate 1 by using an appropriate treatment solution (FIG. 4(*d*)).

As set forth in the foregoing description, the present invention is characterized an causing the ink-repellent coating layer to step into the nozzle so that the ratio of the volume of a space within the nozzle from the front surface of the nozzle plate to the meniscus forming surface with respect to the amount of ink to be jetted is from 0.05 to 0.5. Therefore, the position at which the meniscus vibrates can be regulated correctly by this coating layer not only to prevent stray fly and defective jetting but also to allow an ink droplet to be jetted with minimum piezoelectric drive energy.

In addition, the present invention is characterized as forming the ink-repellent coating layer on the front surface of the nozzle plate using a photosensitive resin member stepped into the nozzle from the back surface of the nozzle plate as a masking member. Therefore, a satisfactory control can be effected over the step coverage of the coating layer that regulates the position at which the meniscus vibrates, which in turn contributes to eliminating inconsistency among products and hence forming highly reliable nozzle plates.

What is claimed is:

1. An ink jet print head for a piezoelectrically driven on-demand ink jet printer, the ink jet print head being adapted to jet therefrom an ink droplet of a predetermined droplet volume, the ink jet print head comprising:

a nozzle plate having a front surface and a nozzle formed therethrough;

an ink-repellent coating layer covering the front surface of the nozzle plate;

the ink-repellent coating layer extending from the front surface of the nozzle plate to coat the nozzle on an inner surface thereof for a respective distance, but not all of the inner surface of the nozzle; and the part of the ink-repellent coating layer on the inner surface of the nozzle at said respective distance defining a meniscus-forming surface for ink;

wherein the volume of a space within the nozzle between the front surface of the nozzle plate and the meniscus-forming surface is in a range from 0.05 to 0.5 times the predetermined droplet volume.

2. The ink jet print head as set forth in claim 1, wherein the ink-repellent coating layer is formed of a eutectoid plating.

3. The ink jet print head as set forth in claim 1, wherein the ink-repellent coating layer is formed of a fluorine-containing high molecular resin member other than a eutectoid plating.

4. A piezoelectrically driven on-demand ink jet printer adapted to jet an ink droplet of a predetermined droplet volume, comprising:

a nozzle plate comprising a plate having a front surface and a back surface, and having a nozzle formed therethrough for jetting said ink droplet in a direction from said back surface to said front surface, the nozzle having a front end at said front surface of said nozzle plate and a back end at said back surface of said nozzle plate;

said nozzle having a greater diameter at said back end than said front end;

said nozzle having, at said front end, a cylinder-like portion that has a respective length, and having, at said back end, a funnel-shaped portion joining said cylinder-like portion, and means for regulating the position in said nozzle of a meniscus of ink in said printer;

wherein:

said means for regulating comprises an ink-repellent coating layer disposed on said front surface of said nozzle plate and in said nozzle, said ink-repellent coating layer in said nozzle extends from said front and toward said back end for a respective distance that defines a step coverage of said ink-repellent coating layer, said step coverage of said ink-repellent coating layer is less than said respective length of said cylinder-like portion of said nozzle, a first volume Vm is defined as a space within said nozzle between said front end and said meniscuse, a second volume Vi is defined as said predetermined droplet volume, and said ink-repellent coating layer disposed in said nozzle causes said first and said second volume to have the relationship of $Vi \cdot 0.05 \leqq Vm \leqq Vi \cdot 0.5$.

5. The ink jet printer as set forth in claim 4, wherein said ink-repellent coating layer is formed of a eutectoid plating.

6. The inkjet printer as set forth in claim 4, wherein said ink-repellent coating layer is formed of a fluorine-containing high molecular resin member other than a eutectoid plating.

7. The ink jet printer has set forth in claim 4, wherein said ink is jetted in response to a piezoelectric drive energy.

8. A piezoelectrically driven on-demand ink jet printer adapted to jet an ink droplet of a predetermined droplet volume, comprising:

a nozzle plate comprising a plate having a front surface and a back surface, and having a nozzle formed therethrough for jetting said ink droplet in a direction from said back surface to said front surface, the nozzle having a front end at said front surface of said nozzle plate and a back end at said back surface of said nozzle plate;

said nozzle having a bell-like flared shape with a greater diameter at said back end than said front end, and a respective nozzle length; and means for regulating the position in said nozzle of a meniscus of ink in said printer;

wherein:

said means for regulating comprises an ink-repellent coating layer disposed on said front surface of said nozzle plate and in said nozzle, said ink-repellent coating layer in said nozzle extends from said front end toward said back end for a respective distance that defines a step coverage of said ink-repellent coating layer, said step coverage of said ink-repellent coating layer is less than said respective nozzle length, a first volume Vm is defined as a space within said nozzle between said front end and said meniscus, a second volume Vi is defined as said predetermined droplet volume, and said ink-repellent coating layer disposed in said nozzle causes said first and said second volume to have the relationship of $Vi\ 0.05 \leqq Vm \leqq Vi \cdot 0.5$.

9. The ink jet printer as set forth in claim 8, wherein said ink-repellent coating layer is formed of a eutectoid plating.

10. The ink jet printer as set forth in claim 8, wherein said ink-repellent coating layer is formed of a fluorine-containing high molecular resin member other than a eutectoid plating.

11. The ink jet printer as set forth in claim 8, wherein said ink is jetted in response to a piezoelectric drive energy.

* * * * *